US005710409A

United States Patent [19]

Schwarzbäcker et al.

[11] Patent Number: 5,710,409

[45] Date of Patent: Jan. 20, 1998

[54] CONTROL ARRANGEMENT FOR COOKING DEVICES

[75] Inventors: Werner Schwarzbäcker, Egling; Boguslaw Ziarko, Murnau, both of Germany

[73] Assignee: Convotherm Elektrogeraete GmbH, Egling, Germany

[21] Appl. No.: 539,989

[22] Filed: Oct. 6, 1995

[30] Foreign Application Priority Data

Oct. 7, 1994 [DE] Germany ..... 44 35 931.4

[51] Int. Cl.[6] ..... H05B 1/02

[52] U.S. Cl. ..... 219/506; 219/714; 219/413; 219/502; 340/825.72

[58] Field of Search ..... 219/506, 502, 219/501, 714, 497, 508, 509, 491, 412, 413; 340/825.69, 825.72

[56] References Cited

U.S. PATENT DOCUMENTS

| | | | |
|---|---|---|---|
| 4,131,786 | 12/1978 | Cooper | 219/487 |
| 4,703,359 | 10/1987 | Rumbolt et al. | 340/825.72 |
| 4,812,963 | 3/1989 | Albrecht et al. | 364/131 |
| 4,837,414 | 6/1989 | Edamula | 219/714 |
| 4,912,463 | 3/1990 | Li | 340/825.69 |
| 5,378,874 | 1/1995 | Holling et al. | 219/506 |

FOREIGN PATENT DOCUMENTS

| | | |
|---|---|---|
| 34 46 394 | 6/1986 | Germany . |
| 41 11 784 | 10/1992 | Germany . |
| G 94 00564.8 | 4/1994 | Germany . |

*Primary Examiner*—Mark H. Paschall

*Attorney, Agent, or Firm*—McAulay Fisher Nissen Goldberg & Kiel, LLP

[57] ABSTRACT

The control arrangement for cooking devices with an embedded control for regulating cooking process whose various parameters can be set by actuating elements at the cooking device is characterized by an external programming unit comprising a hand programming device for setting and storing, independently from the embedded control of the respective cooking devices, different cooking programs, diagnostic programs and user functions which can be called, checked and changed optionally and for transmitting such programs to every embedded control of every optional cooking device.

4 Claims, 4 Drawing Sheets

CONTROL ARRANGEMENT FOR COOKING DEVICES

BACKGROUND OF THE INVENTION a) Field of the Invention

The invention is directed to a control arrangement for cooking devices with an embedded control for regulating cooking processes whose various parameters can be set by actuating elements at the cooking device.

b) Description of the Related Art

In cooking devices known from the prior art the existing embedded control makes it possible to set the various cooking programs, depending on the foods to be prepared, by means of the controls arranged on the front panel. For example, a cooking program can be operated with only hot air, with only steam, or with a combination of hot air and steam at different temperatures, different time settings and with different ways of switching off. The setting and use of such devices requires special knowledge, especially for cooking processes in which different cooking media are used for varying periods of time at different temperatures. Assistant personnel do not possess such special knowledge so that operation can easily be mismanaged. However, even when performed by specialists, such setting is very time-consuming, in particular if there are a number of such cooking devices in a large kitchen. Further, special actuating elements (knobs and buttons) and displays are required for programming cooking processes.

OBJECT AND SUMMARY OF THE INVENTION

The primary object of the present invention is to provide a control arrangement for cooking devices by means of which any desired cooking program can easily be made available in cooking devices and operated in a simple manner.

According to the invention, this object is met in a control arrangement for cooking devices of the type described above by means of an external programming unit comprising a hand programming device for setting and storing, independently from the embedded control of the respective cooking devices, different simple cooking programs and/or optional combination cooking programs or complex cooking programs, diagnostic programs and user functions which can be called, checked and changed optionally and for transmitting such programs to every embedded control of every optional cooking device. Programming work is considerably facilitated in a further development of the invention in that the hand programming device has a plain text display and user guide. In a particularly advantageous further development of the invention, the set cooking programs and user functions can be transmitted via remote control.

Due to this inventive design, it is possible to program and store any desired cooking program comprising a plurality of successive cooking instructions by means of the hand programming device with the assistance of the plain text display and user guide and to transmit this cooking program to the embedded control of every other optional cooking device. Accordingly, it is possible, for example, to program a plurality of cooking devices with the same cooking program so that it is no longer necessary to carry out the extremely time-consuming work of setting the individual devices as was previously conventional. Moreover, it is ensured that the same program will in fact run in all of the cooking devices. Errors which could occur if the settings were effected directly at the devices can now be practically avoided, since the cooking programs which are programmed and accordingly set in the hand device can be checked and changed if necessary before transmitting them. Of course, cooking programs which have already been set can be changed subsequently.

Another substantial advantage of the construction according to the invention consists in that the external programming unit is independent from the cooking device, i.e., a new program can be programmed in the hand device regardless of the respective operation currently being performed by the cooking device and can be transmitted to the corresponding embedded control of the cooking device when needed. Thus it is not necessary to interrupt the operation actually taking place in order to reset the device. Since complicated cooking programs can also be associated with an individual control element, operation of the cooking device is extremely simple and clearly arranged for the user once the programming has been carried out via the external programming unit. Thus, there is a clear separation between simple and frequently used operations of the cooking device and the setting and programming of new or more complicated cooking programs.

After the cooking programs programmed in the hand device are transmitted to the embedded control of an optional cooking device, this cooking program can be activated by an individual control element on the cooking device in an advantageous manner according to a further development of the invention. Accordingly, different cooking programs can be associated with each control element on the cooking device and can be run by pressing the individual control element so that a time-consuming setting procedure for the device is dispensed with. Symbols which are associated with and which characterize the respective cooking programs can then be assigned to the control elements so that the cooking device can also be operated by assistants without the risk of incorrect actuation of the cooking device. In a further development of the invention, any optional actuating element of the cooking device serving to trigger a user function can also be locked by the external programming unit so that these user functions can only be triggered by the appropriate specialists having access to the hand programming device.

According to an advantageous further development of the invention, optional combination cooking programs or complex cooking programs can be transmitted to the embedded control as a program unit by the hand programming device in the form of an identification code and can be activated at the embedded control in the form of the same adjustable code.

The set cooking programs can also be recorded in written form via a printer. This can be effected in a simple manner since the hand programming device can be connected to a printer which is set up outside the kitchen, because such a process could not be carried out in the kitchen owing to the working conditions.

A diagnostic program which can carry out an error search in a simple manner in the event of a malfunction of the cooking device can also be set and stored in the external programming unit.

The set cooking programs and user functions can be transmitted without cables, e.g., via radio signals and infrared signals, as well as with cables.

By connecting the external programming unit to a central, main programming unit via modem in a further development of the invention, new cooking programs can be transmitted from a central location to a plurality of secondary locations outfitted with external programming units of this type without the need for carrying out the respective programming in the individual secondary locations.

For a better understanding of the present invention, reference is made to the following description and accompanying drawings while the scope of the invention will be pointed out in the appended claims.

DESCRIPTION OF THE PREFERRED EMBODIMENTS

Figure 1:
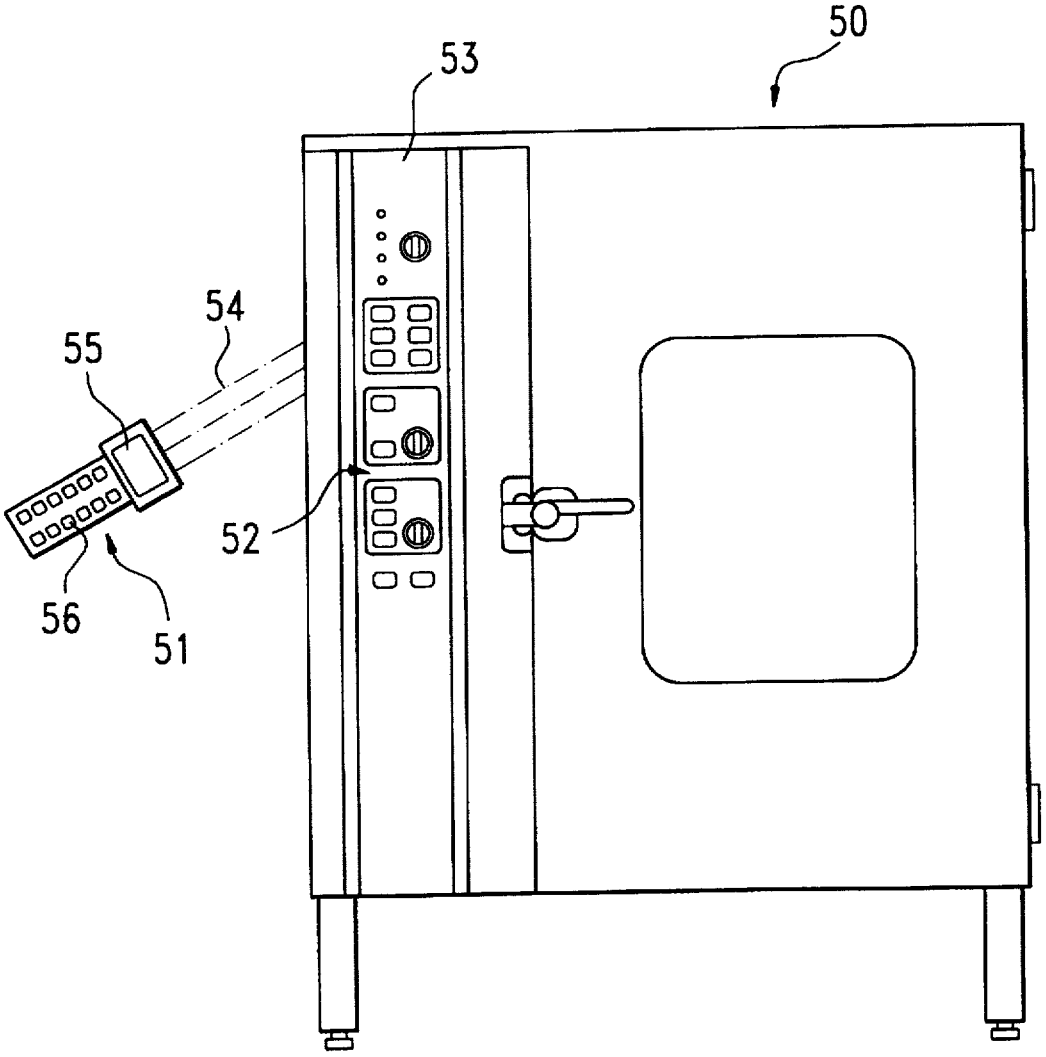
FIG. 1 shows a front view of a cooking device with a hand programming device.

As can be seen from FIG. 1, the control arrangement for a cooking device, designated in its entirety by 50, has an external programming unit, namely a hand programming device 51, and an embedded control which is arranged in the cooking device 50 behind the control elements on the front panel 53, designated in their entirety by 52, and which can also be activated without the hand programming device 51 for executing a determined cooking process by means of the control elements 52. Special cooking programs which are set in the hand programming device 51 can be transmitted by the latter to the control without the use of cables as is indicated by the dash-dot lines 54. The running of a determined cooking process can be controlled either by the basic control functions which are entered by means of the control elements 52 or a determined cooking program which is assigned to a determined control element can be transmitted to the control of the cooking device 50 and started by actuating this control element without having to select different parameters such as temperature, cooking time, etc. by means of the individual control elements, since the complete cooking program has been transmitted to the control by means of the hand programming device 51.

Figure 2:
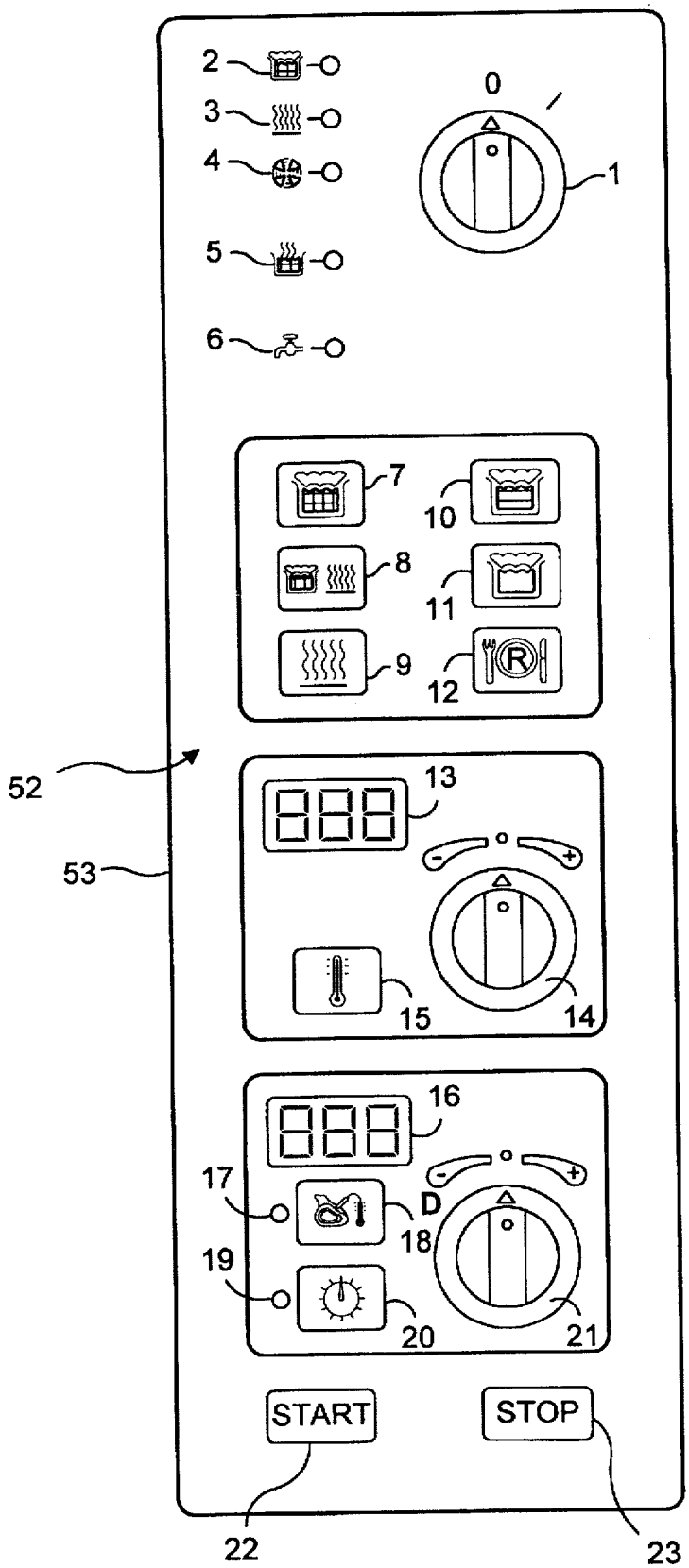
FIG. 2 shows an enlarged view of the control elements of the cooking device according to FIG. 1.

The control elements 52 and their functions will first be explained with reference to FIG. 2. A device switch, designated by 1 in FIG. 2, serves to start the operation of the entire device, i.e., when the device is switched on by means of the device switch 1, the steam generator which provides the cooking device 50 with the steam required for certain cooking processes is automatically filled and heated. Function displays for the steam supply, for an infrared heating device, for a fan motor and for showing the ready state of the steam generator and a low water level in the steam generator are designated by 2 to 6. Various cooking programs, for which different parameters have been set by means of the control elements to be described below, are started by actuating one of the buttons 7 to 12. By pressing button 7, a steam program is started for steaming and cooking or also for cleaning the cooking device, during which the temperature automatically reaches a maximum 100° C. corresponding to the steam temperature at atmospheric pressure. When this program is running, the digital display 13 for the reference/actual temperature in the cooking space is illuminated. Pressing button 8 starts a cooking process in which the steam fed into the cooking space is superheated by means of infrared heating. This program is used for roasting, baking and stewing and the temperature can be adjusted between 100° C. and 250° C. by the switch 14. The temperature button, designated by 15, has a twofold function for setting the desired temperature in the cooking space on the one hand when the button is illuminated and to serve as a readout of the actual temperature in the cooking space when the button is not illuminated. When button 9 is pressed, only hot air within a temperature range of 30° C. to 250° C. is circulated in the cooking space. This program is used for baking, grilling, toasting and browning. Button 10 is used for bio-steaming, as it is called, i.e., for gentle steaming, which may be selected for dishes such as fish, cured meat, egg dishes, etc., in which steam is blown into the cooking space at a temperature between 30° C. and 98° C. and continuously circulated by a fan. Button 11 provides a program for quick-steaming starchy foods such as potatoes in which the temperature can be adjusted continuously between 105° C. and 120° C. by means of the switch 14. Button 12 starts a process for regenerating ready-to-serve prepared dishes in which the temperature can be adjusted continuously between 120° C. and 160° C. The digital displays comprised in field 16 are used for a readout of the desired/actual internal temperature of a roast, to display the reference/actual cooking time, and to display the cooking time which has already elapsed. Button 18 is used to affect the control in such a way that the cooking process is regulated depending on the internal temperature determined in the roast by means of a temperature gauge. This button has a double function and serves for adjusting the reference internal temperature when the button is illuminated and for a readout of the actual internal temperature when the button is not illuminated. The function display 17 lights up when the cooking process is regulated as a function of the internal temperature. Button 20, which also has a twofold function, can be used to adjust the cooking time when the button is illuminated. When the button is not illuminated it serves as a readout for the cooking time remaining. Function display 19 lights up to indicate that the cooking time has been set. The desired internal temperature can be adjusted between 20° C. and 99° C. by means of switch 21. Further, this switch serves to set the desired cooking time from 0 to 180 minutes and switches on continuous operation in position D. Further, if no other button is pressed, the cooking time which has already elapsed can be read out by turning the switch all the way to the left until it contacts its stop. Button 22 is used for starting a program which has already been set by the control elements described above, while button 23 serves to stop a program which is running or to confirm that a program has ended. The end of the program is indicated acoustically or optically. These signals are then canceled by pressing button 23.

Button 23, which has a twofold function, is used to switch the control in such a way that, for example, the various codes under which the complex cooking programs have been stored in the embedded control can be called.

It follows from the description of the control elements and their functions that the user is able to set different programs. However, the user must also set not only the type of operation, that is, steam, hot air, etc., but also the operating temperature and the cooking time. Obviously, special knowledge of cooking as well as special knowledge of the operation of the device is required for selecting the correct cooking program with the correct temperature setting and the correct cooking time for determined dishes.

In order to simplify this complicated setting process, particularly when large quantities of the same kind of food are to be prepared in large dining facilities, the desired cooking program can be composed, i.e., programmed, and transmitted to the control in the cooking device by means of the hand programming device 51, the program which is set in this manner being associated with a determined control element. For example, if the same kind of fish dish is to be prepared, a program comprising gentle steaming is composed in the hand programming device 51. For this purpose, a determined temperature and a determined cooking time are programmed at the same time so that, assuming button 10 is assigned this function, the user need only press button 10 without having to set the temperature and the cooking time. It is also possible to block all the rest of the buttons by means of the hand programming device 51 so as to prevent incorrect use. Other buttons can also be set for other programs in accordance with the example described above. For example, a program for roasting large pieces of meat can be assigned to button 8 and the hand programming device can be used to combine the "roast" function, corresponding to the original function of button 8 provided in the device, with the function of the internal temperature button 18 and with the function of button 20 which adjusts the cooking time. All of these process parameters can be combined in the hand programming device 51 and transmitted to the control of the cooking device as a cooking program so that the user need only press button 8. There is no need for the user to take into account any other settings. Many different programs can be associated with buttons 7 to 12 in the manner describe above and can always be called until the next change is made. However, it is also possible to block programs which have already been stored so that only one or two buttons can be activated. The rest of the control elements for setting the cooking time and adjusting the cooking temperature and, e.g., for setting cooking as a function of the internal food temperature can then be blocked.

Thus, as follows from the examples explained above, the advantage of this hand programming device consists in simplifying the use of a cooking device. Another advantage consists in that a plurality of cooking devices which are set up in a large kitchen can be programmed in an identical manner so as to prevent incorrect settings and deviations between the individual cooking devices.

Figure 3:
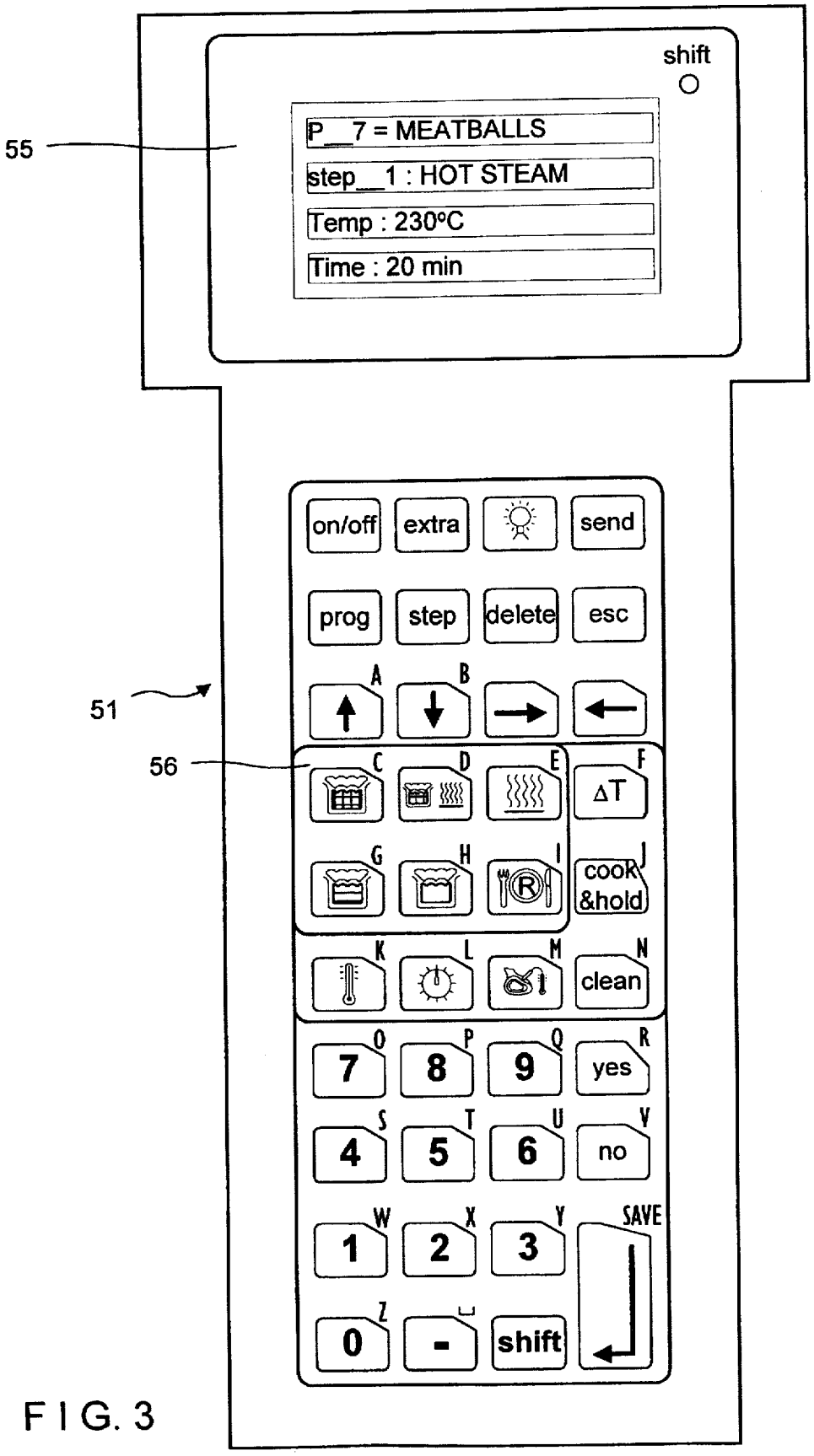
FIG. 3 shows an enlarged view of the hand programming device.
Figure 4:
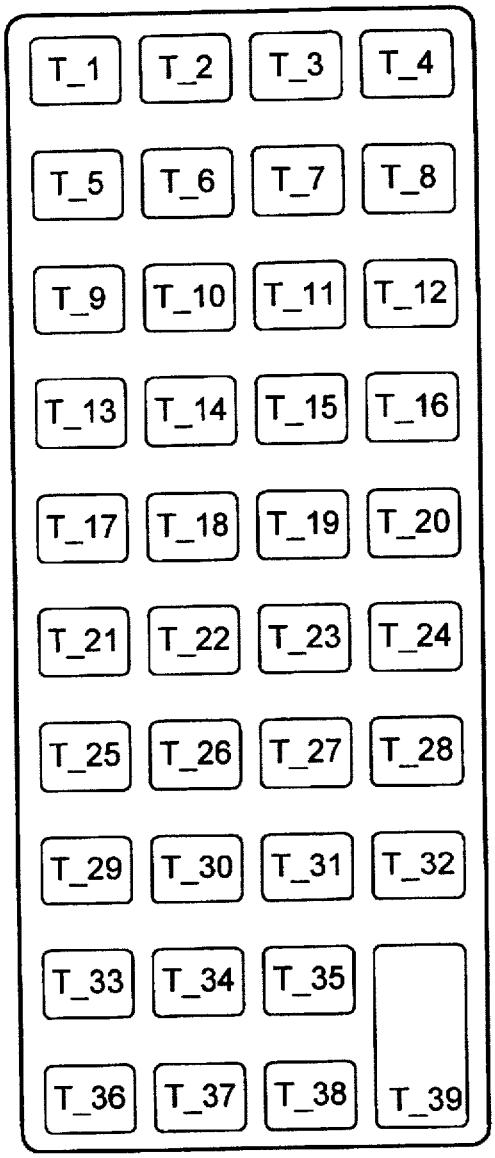
FIG. 4 shows a schematic view of the control elements of the hand programming device.

The control elements of the hand programming device 51 and their functions will be explained more fully with reference to FIGS. 3 and 4. FIG. 3 shows a top view of a hand programming device of this kind with the buttons as they actually appear, whereas the individual buttons are designated by reference numbers T-1 to T-39 in the schematic view shown in FIG. 4 to simplify the description of the functions.

The hand programming device, designated in its entirety by 51, comprises a four-line display 55 and a control element field, designated in its entirety by 56, by means of which the individual programs can be set and transmitted to the control of the cooking device.

The device is switched on and the display is activated by means of button T-1. A menu with special functions is called by pressing button T-2. Button T-3 serves for switching the display light on and off, while the set programs are transmitted to the control of the cooking device by means of button T-4. A stored program can be called by means of button T-5. Button T-6 is activated in order to select a determined cooking step or to insert it in a program. Button T-7 serves to cancel entries, program parts and entire programs. Button T-8 serves to jump to the next line, while buttons T-9 to T-12 serve to move a cursor in the directions shown by the arrows. Buttons T-13 to T-20 are used to select automatic steaming, hot steam, hot air, delta-T cooking, bio-steaming, quick steaming, regenerating, and cook & hold cooking. The cooking space temperature, delta temperature and holding temperature are programmed by button T-21, while button T-22 is used to enter the desired cooking time. Button T-23 serves to display the internal food temperature for a roasting process depending on an internal temperature which is determined by a temperature gauge. A program for cleaning the cooking device is called by means of button T-24. Buttons T-25 to T-27, T-29 to T-31, and T-33 to T-36 are used for entering numbers, while buttons T-28 and T-32 are used for responding to yes/no questions. Button T-37 serves to input a continuous operation and to find an unoccupied program space. Button T-38 is used for selecting the letters for text input and for saving. T-39 serves for confirming entries, for calling the help functions and, together with the "shift" key, for storing. Buttons T-9, T-10, and T-13 to T-36 are also used for letters, while button T-37 serves as a space key and button T-39 is used to select "save". These special symbols and functions are obtained by means of button T-38="shift". Button T-38="shift" has a toggle operation. The "shift" function is automatically canceled after saving by means of "shift"+"confirm"="save" and by entering "step 1", where T-6="step".

It can be seen from this description of the control elements of the hand programming device 51 and their functions that a large number of different cooking programs, e.g., gentle steaming, are set at a determined temperature and for a determined cooking time and can then be transmitted to the control of the cooking device by means of the button T-4 described above. The user can access a user guide by calling the menu by means of button T-2, while the set program is displayed in display 55. For example, in the view shown in FIG. 3, a program P-7 for meatballs has been set in which the meatballs are cooked with hot steam at a temperature of 230° C. and a cooking time of 20 minutes. It can be seen from the description above that every desired cooking program can be set in the hand programming device and can be transmitted to the embedded control in the cooking device and the user can call these programs at any time by actuating an individual button or entering a determined code under which complex cooking programs are stored, without having to first carry out laborious setting procedures requiring special knowledge. In order to call complex cooking programs under a certain code the user must act on or switch the embedded control, e.g., by means of button 23, in such a way that the various codes can be called by the switch 14 and the corresponding programs can be started by means of the start button. Storing programs in this way and the corresponding ability to call complex programs makes it possible to store a virtually unlimited number of programs in the embedded control. Accordingly, the control arrangement is not confined only to the programs stored under buttons 7 to 12, but rather, as was already described, many other programs can be started after calling a determined code, e.g., a number.

While the foregoing description and drawings represent the preferred embodiments of the present invention, it will be obvious to those skilled in the art that various changes and modifications may be made therein without departing from the true spirit and scope of the present invention.

What is claimed is:

1. A control arrangement for cooking devices each with an embedded control for regulating cooking processes whose various parameters can be set by actuating elements at the respective cooking device, comprising:

an external programming unit comprising hand-held programming means for setting and storing, independently from the embedded controls of the respective cooking devices, different simple cooking programs and/or optional combination cooking programs or complex cooking programs, diagnostic programs and user functions which can be called, checked and changed optionally and for transmitting such programs to the embedded control of each cooking device, said hand-held programming means including a plain text display, a user guide, and a wireless transmitter for transmitting the set cooking programs and user functions, said hand-held programming means as a program unit including means for storing optionally combined cooking programs or complex cooking programs under an identification code and transmitting the stored combined cooking programs or complex cooking programs to each of the embedded controls, each of the embedded controls including means for activating the transmitted combined cooking programs or complex cooking programs by the same adjustable identification code.

2. The control arrangement according to claim 1, including means in the external programming unit for transmitting cooking programs to the embedded control and which can be activated at the embedded control.

3. The control arrangement according to claim 1, wherein said external unit includes means for blocking every optional actuating element of the cooking device serving to trigger a user function.

4. The control arrangement according to claim 1, including means for connecting the external programming unit via modem to a central, main programming unit.

* * * * *

UNITED STATES PATENT AND TRADEMARK OFFICE

CERTIFICATE OF CORRECTION

PATENT NO. : 5,710,409 
DATED : January 20, 1998
INVENTOR(S) : Werner Schwarzbäcker et al.

It is certified that error appears in the above-identified patent and that said Letters Patent is hereby corrected as shown below:

Title page,
Item [75], should read -- Werner Schwarzbäcker, Eglfing, Germany --
Item [73], should read -- Convotherm Elektrogeraete GmbH, Eglfing, Germany --

Signed and Sealed this

Tenth Day of June, 2003

JAMES E. ROGAN
*Director of the United States Patent and Trademark Office*